US009566527B2

(12) United States Patent
Schilke et al.

(10) Patent No.: US 9,566,527 B2
(45) Date of Patent: Feb. 14, 2017

(54) ROLLING VEHICLE TRACK

(71) Applicant: Rocky Mountain Coasters, Inc., Hayden, ID (US)

(72) Inventors: Alan Schilke, Hayden, ID (US); Fred Grubb, Hayden, ID (US); Dody Bachtar, Hayden, ID (US)

(73) Assignee: Rocky Mountain Coasters, Inc., Hayden, ID (US)

( * ) Notice: Subject to any disclaimer, the term of this patent is extended or adjusted under 35 U.S.C. 154(b) by 316 days.

(21) Appl. No.: 14/038,025

(22) Filed: Sep. 26, 2013

(65) Prior Publication Data

US 2014/0020591 A1 Jan. 23, 2014

Related U.S. Application Data

(63) Continuation of application No. 12/881,142, filed on Sep. 13, 2010, now Pat. No. 8,590,455.

(60) Provisional application No. 61/241,785, filed on Sep. 11, 2009.

(51) Int. Cl.
*A63G 7/00* (2006.01)
*A63G 21/04* (2006.01)

(52) U.S. Cl.
CPC ..... *A63G 7/00* (2013.01); *A63G 21/04* (2013.01); *Y10T 29/49826* (2015.01)

(58) Field of Classification Search
CPC ..... Y02T 29/49798; Y02T 29/49863; Y02T 29/49968; A63G 21/04
USPC ..... 104/53, 55, 56, 63, 64–66, 118, 119; 29/33 R, 33 K, 57, 701, 281.1, 283.5
See application file for complete search history.

(56) References Cited

U.S. PATENT DOCUMENTS

| | | | |
|---|---|---|---|
| 1,501,060 | A | 7/1924 | Miller |
| 1,741,286 | A | 12/1929 | Church |
| 1,755,030 | A | 4/1930 | Schmeck |
| 3,217,659 | A | 11/1965 | Ford |
| 3,225,703 | A | 12/1965 | Lemcke |
| 3,403,633 | A | 10/1968 | Schwarzkopf |
| 4,208,969 | A | 6/1980 | Baltensperger et al. |
| 4,274,336 | A | 6/1981 | Pater et al. |
| 4,429,845 | A | 2/1984 | Stover et al. |
| 4,752,011 | A | 6/1988 | Pudney |
| 5,175,405 | A | 12/1992 | Karimine et al. |
| 5,291,834 | A | 3/1994 | Quaas |
| 5,687,649 | A | 11/1997 | Koeninger et al. |

(Continued)

FOREIGN PATENT DOCUMENTS

KR 20070107666 11/2007

OTHER PUBLICATIONS

International Preliminary Examination Report dated Mar. 13, 2012 issued in PCT/US2010/048683 (7 pages).

(Continued)

*Primary Examiner* — Zachary Kuhfuss
(74) *Attorney, Agent, or Firm* — The Pizarro Firm

(57) ABSTRACT

A method of fabricating an amusement park ride track utilizing stock, planar materials, namely comprising of creating elongated, curved structures from planar materials. A roller coaster track capable of being fabricated from multiple planar pieces without heating or bending. Other embodiments are described which utilize elongated, curved structures such as ski lifts, people movers, staircases and architectural structures. A jig is disclosed for providing for ease of manufacture of the elongated, curved structures.

13 Claims, 9 Drawing Sheets

(56) References Cited

U.S. PATENT DOCUMENTS

| | | | | |
|---|---|---|---|---|
| 6,263,800 | B1 | 7/2001 | Wilson | |
| 7,047,888 | B2 | 5/2006 | Richards | |
| 7,131,382 | B2 | 11/2006 | Gordon | |
| 8,117,968 | B2 | 2/2012 | Rose et al. | |
| 2001/0003261 | A1 | 6/2001 | Stengel | |
| 2006/0137563 | A1 | 6/2006 | Cummins | |
| 2008/0226846 | A1* | 9/2008 | Hill | G09F 1/06 428/13 |
| 2009/0114114 | A1 | 5/2009 | Rose et al. | |
| 2009/0230205 | A1 | 9/2009 | Hepner et al. | |
| 2010/0024677 | A1* | 2/2010 | Jager | B61B 10/001 104/250 |
| 2010/0310893 | A1 | 12/2010 | Derbyshire et al. | |
| 2011/0146528 | A1 | 6/2011 | Schilke et al. | |

OTHER PUBLICATIONS

International Search Report dated Nov. 3, 2010 issued in PCT/US2010/048683 (2 pages).
Written Opinion of the International Searching Authority dated Nov. 3, 2010 issued in PCT/US2010/048683 (6 pages).
International Search Report and Written Opinion dated Jun. 7, 2013 in PCT Patent Application PCT/US2013/032653 (15 pages).
European Search Report dated Sep. 10, 2013 issued in related European patent application serial No. 10816247.0 (6 pages).
Office Action dated Dec. 18, 2012 issued in related U.S. Appl. No. 12/881,142 (13 pages).

* cited by examiner

ROLLING VEHICLE TRACK

CROSS REFERENCE TO RELATED APPLICATIONS

This application is a continuation of U.S. patent application Ser. No. 12/881,142 filed on Sep. 13, 2010, which claims priority to the earlier provisional application entitled "Improved Rolling Vehicle Track" filed Sep. 11, 2009 and having Ser. No. 61/241,785. The disclosures of the above-related applications are hereby incorporated herein by reference in their entirety.

TECHNICAL FIELD

The present invention pertains to an improved rolling vehicle track and its manufacture. More particularly, preferred embodiments of the present invention pertain to an improved method of designing and manufacturing amusement park track that comprises affixing a plurality of planar materials to form a track rather than the conventional methods of bending straight track. Methods of use of the improved track are also included. Other alternate embodiments of the invention comprise other complex structures such as ski lifts, people movers and staircases.

BACKGROUND

Roller coasters, other amusement park rides, ski lifts and other rolling vehicle people moving devices frequently have a need for complicated tracks to either provide a dynamic experience or follow rugged terrain. As such, many of these tracks for such rolling vehicles are fabricated from steel pipe, which is traditionally heated and bent to acquire its desired shape.

Unfortunately, heating and manipulating steel rod or steel pipe in such a way, and permanently bending such material, causes significant fatigue in the material. This fatigue is then existent in the resultant structure before a stress or load is applied to such apparatus, such as inherent stresses in the installation of the track (static loads) and dynamic loads applied to the track (e.g. a passing roller coaster carriage). Over time, the culmination of the manufacturing stresses, static stresses and dynamic stresses require that the traditional pipe track be replaced frequently over time.

Further, when steel rod or steel pipe is heated and bent into complex designs, the rod or pipe does not necessarily bend as desired. Metal will typically seek to bend at its weakest point or where the most force is applied over a span. As such, the end result of a fabricated steel structure may not exactly match the desired design, which either results in repeated attempts of fabrication or settling for a less than optimal result. In particular, structural and material efficient designs such as triangular tubing, square or rectangular tubing, or other metal tubing that has airspace within the cross section of the steel structure can be vulnerable to both deformation and cracking.

At the present time, metal (namely steel) roller coasters are fabricated from round, straight steel rod or steel pipe which are bent into desired formations for the necessary roller coaster application.

Based on our knowledge of the industry, there are no roller coasters in existence where the tracks are fabricated from stock planar metal material that has been cut and welded together to form the desired curve track. Such an invention, if possible, would be a highly desirable benefit as the newly developed track, which has not been bent, deformed or heated, would retain its original strength without unnecessary fatigue placed on the material by traditional bending methods. With such superior material fitness in light of the absence of fatigue during manufacture, the resulting structure or roller coaster track would be far stronger and last longer than traditional approaches. Such strength and durability, therefore, can effectively result in roller coasters and other structures being built on a larger scale or more efficient budget as compared to earlier traditional approaches.

Therefore, what is needed in the art of amusement park rides and other complex curved structures is a new approach to the fabrication and manufacture of an elongated, curved structure such as a roller coaster track. Preferably, such an improved track minimizes manufacturing stresses, creates a desired result, and further preferably reduces the costs of materials and manufacture when compared to traditional roller coaster, amusement ride, ski lift, staircase or other elongated structures.

SUMMARY

Embodiments of the present invention are generally directed toward a new method to fabricate an elongated, curved structure such as an amusement park roller coaster track or spiral staircase support. Once a three dimensional design of the elongated structure is determined, specialized software can be utilized to map out the various pieces of flat material to be cut out—pieces that will ultimately become the components of the elongated, curved structure. Such component pieces, in preferred embodiments, are cut into their respective designed shapes using a plasma cutter or other conventional device and are subsequently attached together (e.g. welded) to form a structurally sound elongated, curved structure.

In one aspect, embodiments of the present invention comprise a method of designing and fabricating such an elongated, curved structure.

In another aspect, such a process also creates a new product of the process, an apparatus which is a curved, elongated structure that comprises a plurality of planar components fixably in permanent communication with one another.

In yet another aspect, a roller coaster can be built upon such an elongated, curved structure. In still another aspect, a ski lift or other people mover can be built upon such an elongated structure that does not require conventional wires or round tracks. Lastly, though in no way limiting the scope of the present invention, a curved staircase or architectural structure can be built upon such an elongated, curved structure that does not require heating, bending or deformation of traditional metal beams.

BRIEF DESCRIPTION OF THE DRAWINGS

Embodiments of the invention are illustrated by way of example, and not by way of limitation, in the figures of the accompanying drawings and in which like reference numerals refer to similar elements.

DETAILED DESCRIPTION OF PREFERRED EMBODIMENTS

Figure 1:
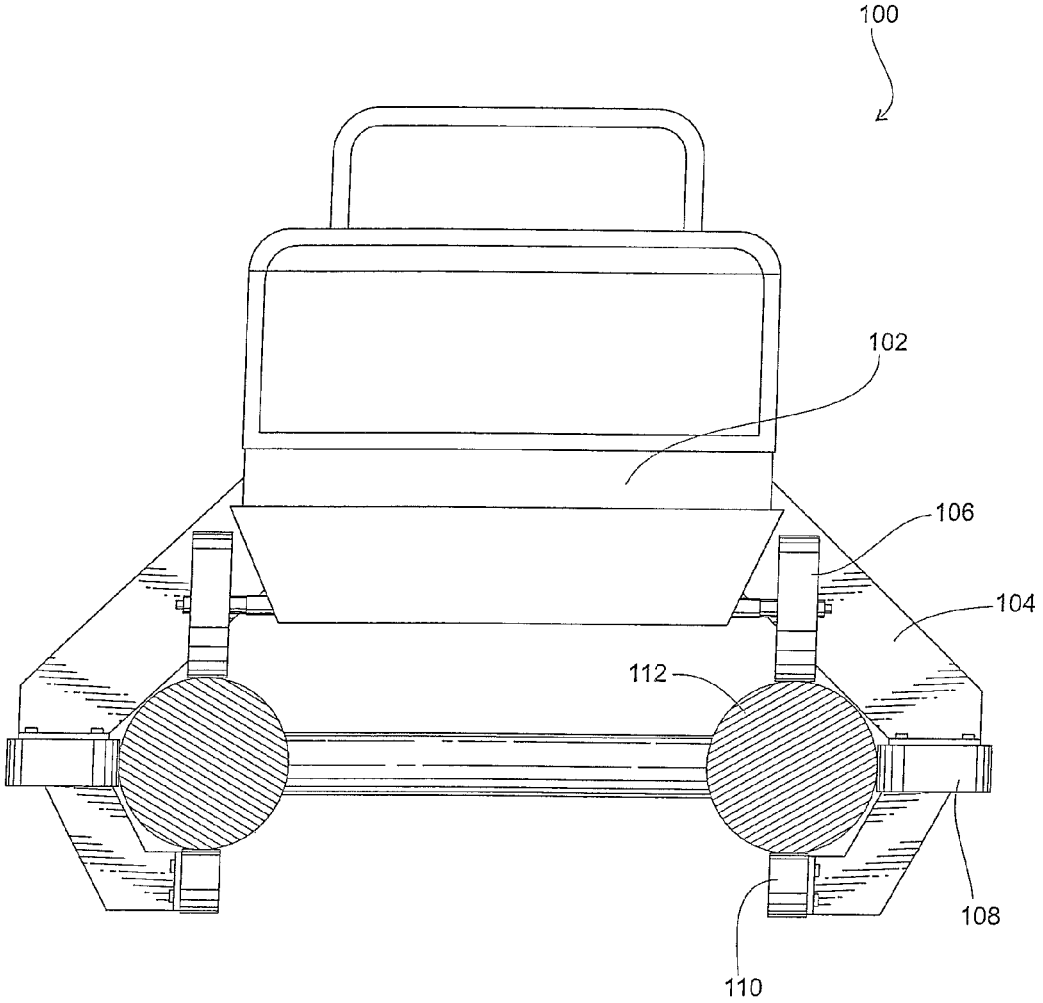
Fig. 1 PRIOR ART
FIG. 1 is a front view of a prior art roller coaster comprising of solid, round tracks.

In the following description, for the purposes of explanation, specific details are set forth in order to provide a thorough understanding of the invention. However, it will be apparent that the invention can be practiced without these specific details. In other instances, well-known structures and devices may be depicted in block diagram form in order to avoid unnecessary detail of the invention relating to the corresponding discussion; and similarly, steps in the disclosed method may be depicted in flow diagram form. Section titles and references appearing within the following paragraphs are intended for the convenience of the reader and should not be interpreted to restrict the scope of the information presented at any given location.

The unique elongated, curved structures and fabrication and use thereof described herein comprise a plurality of advancements within various scopes in the amusement park, people moving, architectural and fabrication arts. As such, various groupings of details, advancements and enhancements are described in more detail hereinafter in the following sections: Functional Overview, Limitations Of Prior Art, New Structures and Fabrication Thereof and Conclusion.

Functional Overview

Embodiments of the present invention are generally directed toward an apparatus comprising an elongated, curved structure adapted to be utilized for various applications. Such applications can include a roller coaster track or other amusement park ride, a people mover (e.g. a ski lift or other motion device whether motorized or non-motorized), a staircase or other architectural structure, or other applications where an elongated, curved structure is required. In preferred embodiments, such an elongated, curved structure comprises many compound curves and is a custom design, such as a roller coaster track.

While a roller coaster track is an exemplary case study for the present disclosure, it is understood that various teachings of the present disclosure are applicable in other contexts such as transportation, architecture and other trades, without limitation. Therefore, an improved roller coaster will be discussed, although this is merely a preferred embodiment of the invention for purposes of the disclosure without limitation. When used herein, references to a "rolling vehicle" are considered equivalent, or broader, than that of a roller coaster, since a roller coaster is an exemplary case of a rolling vehicle upon a fixed track. The teachings herein disclosed can apply equally well to either retrofit or new coaster applications, whether the underlying structure is wood (commonly referred to as a "wood" coaster), or the underlying structure is a steel frame (commonly referred to as a "steel" coaster).

More particularly, preferred embodiments of the invention and present disclosure are configurable, three-dimensional I-box style track that can be fabricated from two-dimensional materials, such as but not limited to planar steel plate. In preferred embodiments of a roller coaster track, an I-box style track typically has a rectangular cross section that resembles the letter "I" in the alphabet (similar to I-beam steel which has only 1 longitudinal plane rather than 2 longitudinal planes in an I-box style design).

As it can be a complex process to determine the specific shape and dimensions necessary for various planar components of such an elongated, curved structure, we have found that specialized computer software developed specifically for this process achieves the best result.

In particular, a roller coaster track is laid out in a three-dimensional computer aided design (CAD) system. Thereby, the track cross-section, track geometry and other aspects are fully detailed in a computerized specification of the track. Various sections of the track are also configured, such that the track can be fabricated in portions of track. Typically such tracks are designed and fabricated as a 2-track system, but one, two, three or even more complex track systems are also contemplated by the present invention.

Once the track sections are fully designed and specified, the sections are mapped out on primarily two-dimensional raw materials such as standard steel plate or steel bar. The utilization of such standard materials is typically of significant advantage over traditional methods which utilize specialized and expensive steel (either in rod or pipe form).

According to embodiments of the present invention, the mapped out two-dimensional section pieces are then cut from the raw steel using conventional cutting or fabrication means such as a plasma cutter, mechanical cutter, water cutter or other conventional cutting means. The specific pieces preferably have hundreds or even thousands of minute specifications, such that complex curves can be accommodated with the cutting of the materials. Typical materials used are ¼" or ⅜" plates of A-36 steel, although other materials can be desirable in alternate configurations or applications.

After the two-dimensional section pieces are cut or fabricated, these pieces are assembled and coupled to one another pursuant to the design and specifications, typically through conventional means such as welding. In the process of such fabrication of the three-dimensional object from primarily two-dimensional pieces, a special jig or mount may be necessary to hold the pieces in their proper position for affixing to other pieces, as discussed further below.

Lastly, the fabricated track sections are assembled together at the site of the amusement park ride, namely through conventional coupling means such as large bolts and nuts, or welding, or other conventional attachment means.

Typically, such a fabrication method of embodiments of the present invention result in an amusement park ride track that is more consistent and optimized pursuant to the original design. The improved track typically is stronger as the track itself is typically free of manufacturing stresses such as heating, bending and installation tweaking. Because the raw materials in the improved track are not stressed during their manufacture or installation, the improved track typically has a longer lifespan and thus does not need as frequent of replacement as traditional "bent pipe" track constructed of either round rod steel or round pipe steel that is heated, bent or both.

As noted above, the improved track can be used in amusement rides (e.g. roller coasters), alpine slides, water parks or other applications where a wheeled vehicle proceeds along a track having curves. It can, similarly in other contexts, be used as support structures for people movers (e.g. motorized or non-motorized walkways, trams, etc.), or for staircases, or other architectural applications requiring custom, elongated, curved structures.

Before a further discussion of the various features of embodiments of the present invention are presented, it is beneficial to understand more about the limitations of the prior art, namely "bent pipe" roller coaster track.

Limitations of Prior Art

FIG. 1 is a front view of a prior art roller coaster comprising of solid, round tracks. A coaster 100 comprises a chassis 102 having a wheel frame 104, the wheel frame 104 thereby coupled to a one or more main wheels 106, a one or more lateral wheels 108 and a one or more bottom wheels 110. The one or more main wheels 106, one or more lateral wheels 108 and one or more bottom wheels 110 roll along a solid, round track 112. Such a coaster 100 typically represents many modern but prior art coasters which require frequent maintenance of the expensive track 112 which must be re-certified, repaired or re-fabricated from new materials on a regular basis to maintain the safety of riders in the chassis 102.

Figure 2A:
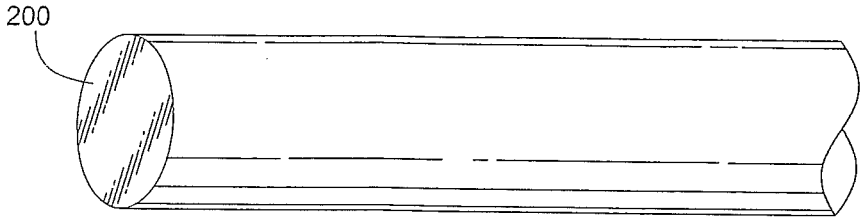
Fig. 2A PRIOR ART
FIG. 2A is an illustration of a straight section of prior art roller coaster track prior to bending.

Turning to FIG. 2A, a straight section of prior art round steel pipe 200 prior to fabrication or bending to become a roller coaster track is illustrated.

Figure 2B:
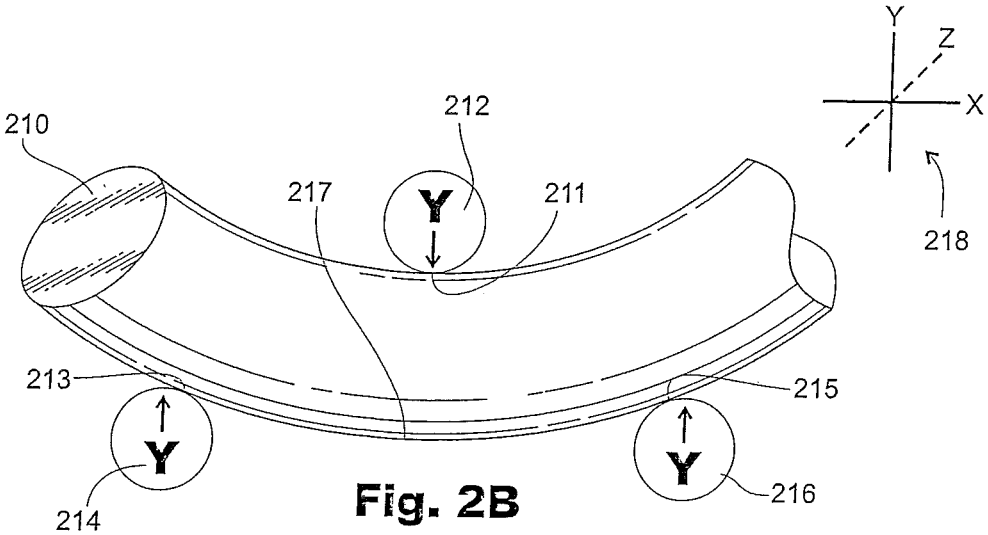
Fig. 2B PRIOR ART
FIG. 2B is an illustration of the section of prior art roller coaster track in FIG. 2A during a bending process in the Y dimension.

FIG. 2B is an illustration of the section of prior art roller coaster track 200 in FIG. 2A, which has been exposed to a bending process in the Y dimension. More particularly, a section of round steel pipe 210 has various forces applied to it in various locations, namely a downward Y force 212 is applied at a location 211, an upward force 214 is applied at a location 213, and an upward force 216 is applied at location 215. The resulting forces 212, 214 and 216, in combination, result in the pipe 210 being bent in an upward configuration at its ends with respect to the Y dimension. The Y dimension is more clarified in a dimensional representation 218.

When pipe 210 is bent in this fashion, which frequently requires substantial heat to be applied to the pipe 210, the material of the pipe 210 can become substantially stressed. In particular, due to the folding inward of the ends of the pipe 210, the material in the pipe 210 in close proximity to location 211 is subjected to a high degree of compression. On the other hand, due to the same folding of the ends of the pipe 210, the material in the pipe 210 in close proximity to locations 213 and 215 is subjected to a high degree of expansion or stretching. In combination, the compression and expansion of the material in the pipe 210 inevitably leads to the pipe 210 having a much lower structural integrity and as such the pipe 210 cannot bear the same loads as a non-bent pipe 200 depicted in FIG. 2A.

Figure 2C:
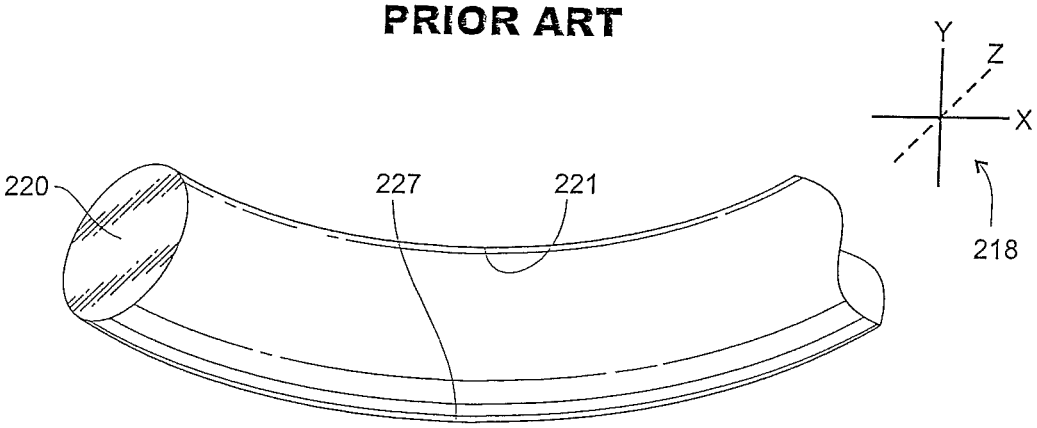
Fig. 2C PRIOR ART
FIG. 2C is an illustration of a section of prior art roller coaster track in FIG. 2B following a bending process in the Y dimension.

FIG. 2C is an illustration of a section of prior art roller coaster track in FIG. 2B following a bending process in the Y dimension. More particularly, a pipe 220 is illustrated as having a slightly less bend than the pipe 210 of FIG. 2B. As is commonly known in the trade, generally a material such as steel must be bent further than the desired result, as even materials such as steel have a degree of elasticity. In this regard, the process of fabricating roller coaster tracks to a high degree of precision becomes very difficult as the amount of force and dynamics to bend the material in the pipe 200 cannot be exactly determined prior to the actual bending. The result, therefore, similar to pipe 220, is a result by "trial and error" rather than fabrication within precise measurements and standards.

It is a frequent occasion that such prior art roller coaster tracks must be bent into compound curves in order to accommodate the needs of the design. As such, many of the pipes used to create roller coaster tracks must be subjected to multiple bending processes, sometimes in the same location.

Figure 3A:
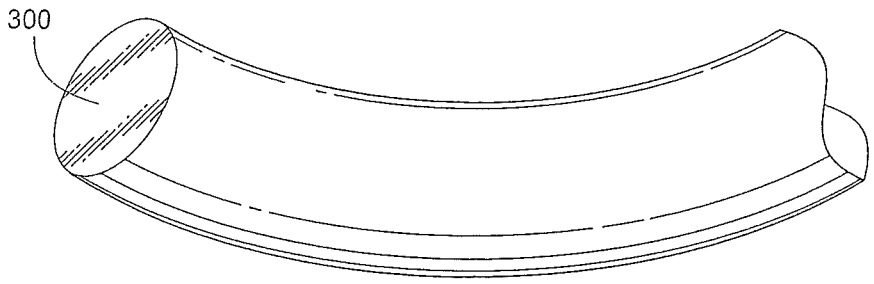
Fig. 3A PRIOR ART
FIG. 3A is an illustration of a section of prior art roller coaster track following a previous bending process in the Y dimension.

FIG. 3A is an illustration of such a section of prior art roller coaster track that must be subjected to a second bending process, following a previous bending process in the Y dimension in FIGS. 2A-2C. A pipe 300 represents a pipe 220 which was previously bent in FIGS. 2A-2C in the Y dimension.

Figure 3B:
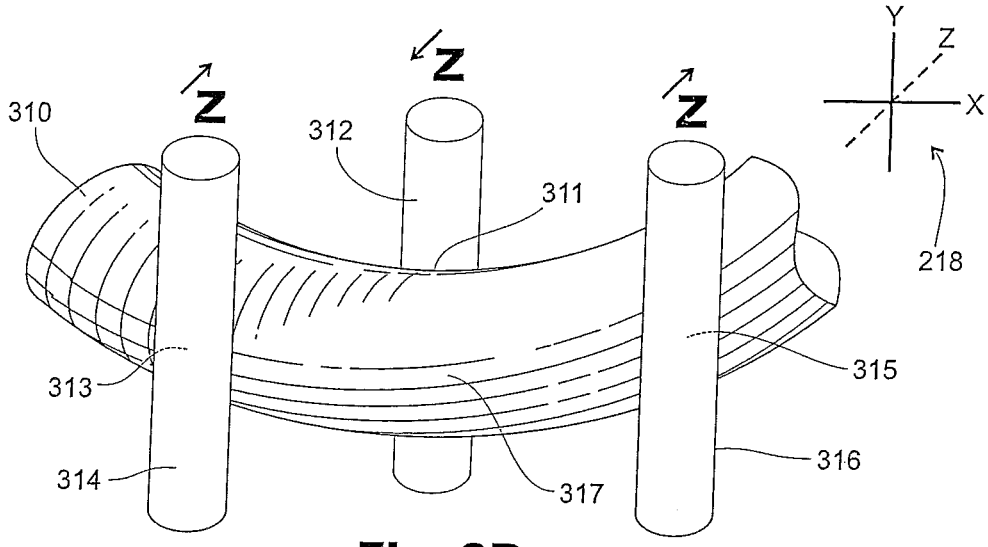
Fig. 3B PRIOR ART
FIG. 3B is an illustration of the section of prior art roller coaster track in FIG. 3A during a bending process in a second Z dimension, thereby causing a compound bend in the track.

Turning to the next figure, FIG. 3B is an illustration of the section of the previously bent pipe 300 of FIG. 3A, which is subjected to a bending process in a second Z dimension. This second bending process thereby causing a compound bend in the track, one bend in the Y dimension (FIGS. 2A-20) and another bend in the Z direction, as represented in the dimension representation 218.

As one can appreciate, a pipe 310 has an outward (from the page) force 312 applied to it in the Z dimension at a location 311, an inward (into the page) force 314 applied to it in the Z dimension at a location 313, and an inward (into the page) force 316 applied to it in the Z dimension at a location 315. In combination, these forces 312, 314 and 316 bend the pipe 310 into a second bend in the Z dimension.

Similar to that described in FIGS. 2A-2C for the Y dimension, the pipe 310 in FIG. 3B is subjected to a second set of stresses, namely a compression at location 311 and an expansion or stretching at location 317. As such, being that the pipe 310 has been subjected to two bends with multiple compressions and expansions in the midsection of the pipe 310, its structural integrity is severely compromised.

Figure 3C:
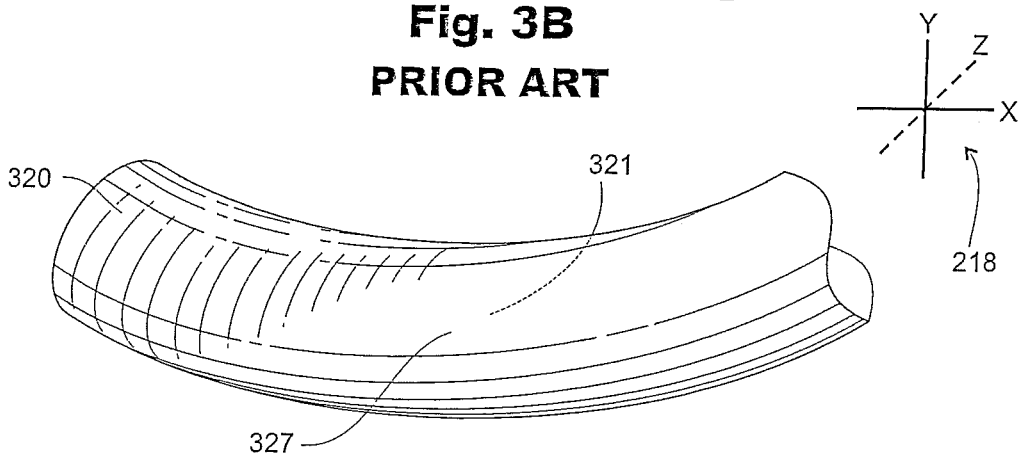
Fig. 3C PRIOR ART
FIG. 3C is an illustration of a section of prior art roller coaster track in FIG. 3B following a bending process in a second Z dimension, thereby having caused a compound bend in the track.

FIG. 3C, similar to FIG. 2C, illustrates a pipe 320 which has been subjected to such bending to reach a desired shape and form. In particular, the pipe 320 can experience structural compression at a location 321 and a structural expansion or stretching at 327, resulting in a weakened roller coaster track when compared to the native, straight steel pipe which was originally not subjected to such forces.

Figure 4A:
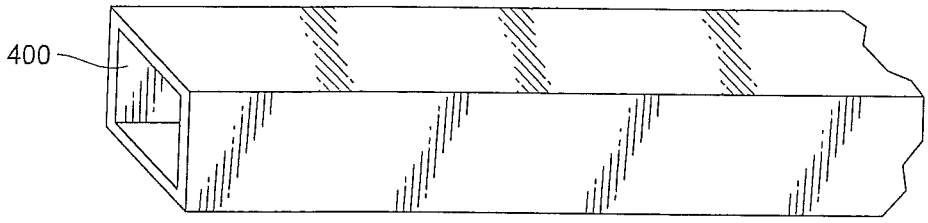
Fig. 4A PRIOR ART
FIG. 4A is an illustration of a section of prior art straight rectangular tubing.

FIG. 4A is an illustration of a section of prior art straight rectangular tubing 400, which is a suitable material for rigid, straight structural purposes but difficult to bend or manipulate for curved applications. While such a pipe could be advantageous over round pipe for roller coaster tracks, such rectangular tubing is difficult to bend or manipulate as further described.

Figure 4B:
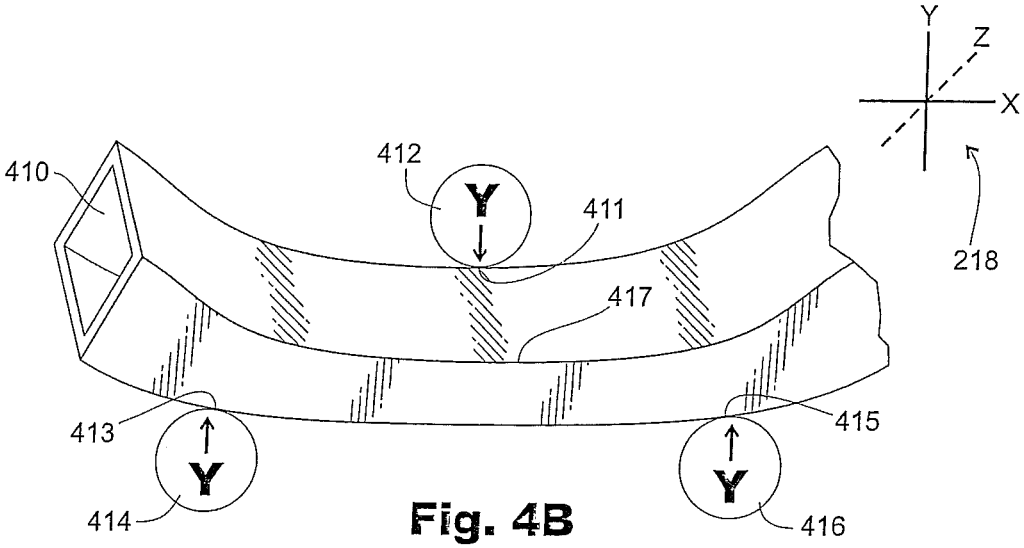
Fig. 4B PRIOR ART
FIG. 4B is an illustration of the section of prior art rectangular tubing in FIG. 4A during a bending process in the Y dimension, thereby causing a deformation in the shape of the tubing.

Turning to the next figure, FIG. 4B is an illustration of the section of prior art rectangular tubing 400 in FIG. 4A during a bending process in the Y dimension, thereby causing a deformation in the shape of the tubing. More particularly, a rectangular tubing 410 is subjected to a downward force 412 in the Y dimension at a location 411, an upward force 414 in the Y dimension at a location 413, and an upward force 416 in the Y dimension at a location 415.

As depicted, the rectangular tubing has been crushed, flattened or otherwise deformed by the forces which have compromised the cross-sectional shape of the rectangular tubing 410. More particularly, a compression force is felt at the location 411, causing the top of the rectangular tubing 410 to be permanently deformed. Similarly, when visually observing an edge 417, the structural integrity of the rectangular tubing 410 can be visually confirmed by the inconsistent profile of the edge 417.

Figure 4C:
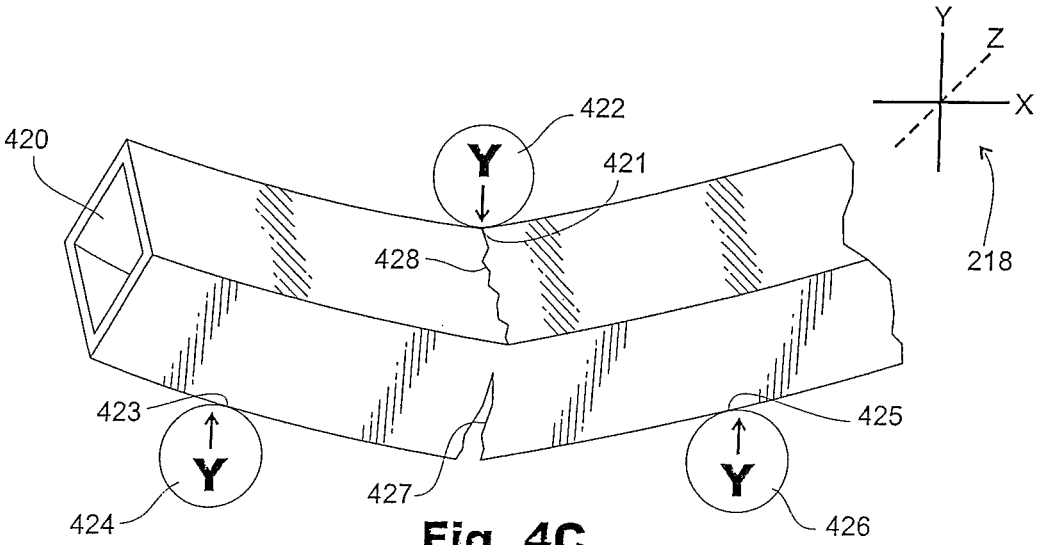
Fig. 4C PRIOR ART
FIG. 4C is an illustration of the section of prior art rectangular tubing in FIG. 4A during a bending process in the Y dimension, thereby causing a failure in the integrity of the tubing.

Similarly, FIG. 4C is an illustration of the section of prior art rectangular tubing in FIG. 4A during a bending process in the Y dimension, thereby causing a failure in the integrity of the tubing. More particularly, a rectangular tubing 420 is subjected to a downward force 422 in the Y dimension at a location 421, an upward force 424 in the Y dimension at a location 423, and an upward force 426 in the Y dimension at a location 425. As can be appreciated at a location 428, the compression forces acting upon the rectangular tubing 420 cause creases or ripples in the surface (and possibly interior) of the rectangular tubing 420. Likewise, a crack 427 is observed in the location where expansion or stretching occurs in the material of the rectangular tubing 420.

As can be fully appreciated by those skilled in the art, using round steel, either in the form of a solid rod or a hollow pipe is the most effective means to develop a roller coaster track under conventional prior art practices—but the process is wanting of several advancements. To name a few, without limitation, first, the material itself is expensive to utilize in round form. Second, the material is difficult to properly bend into the desired form, often resulting in a "trial and error" approach to fabricating the desired tracks. As shown in FIGS. 2A-2C and FIGS. 3A-3C, this process of manufacture also infuses stresses and ultimately weaknesses in the track material.

Third, the material (e.g. steel) is less structurally strong when placed in a round form such as a rod or a pipe, when compared to triangular, rectangular, I-beam or other forms. In particular, the round material is less rigid when subjected to lateral forces (forces lateral to the length of the material).

Unfortunately, as depicted in FIGS. 4A-4C, utilizing rectangular (or other forms such as triangular or I-beam) tubing, while structurally more efficient than round rod or pipe in straight pieces, are far more complex to bend into curves. Much less, that often whatever material or tubing is used, it must be bent in multiple dimensions in compound curves as well as potentially in need of a twisting of the material itself to accommodate the proper desired configuration.

New Structures and Fabrication Thereof

Figure 5:
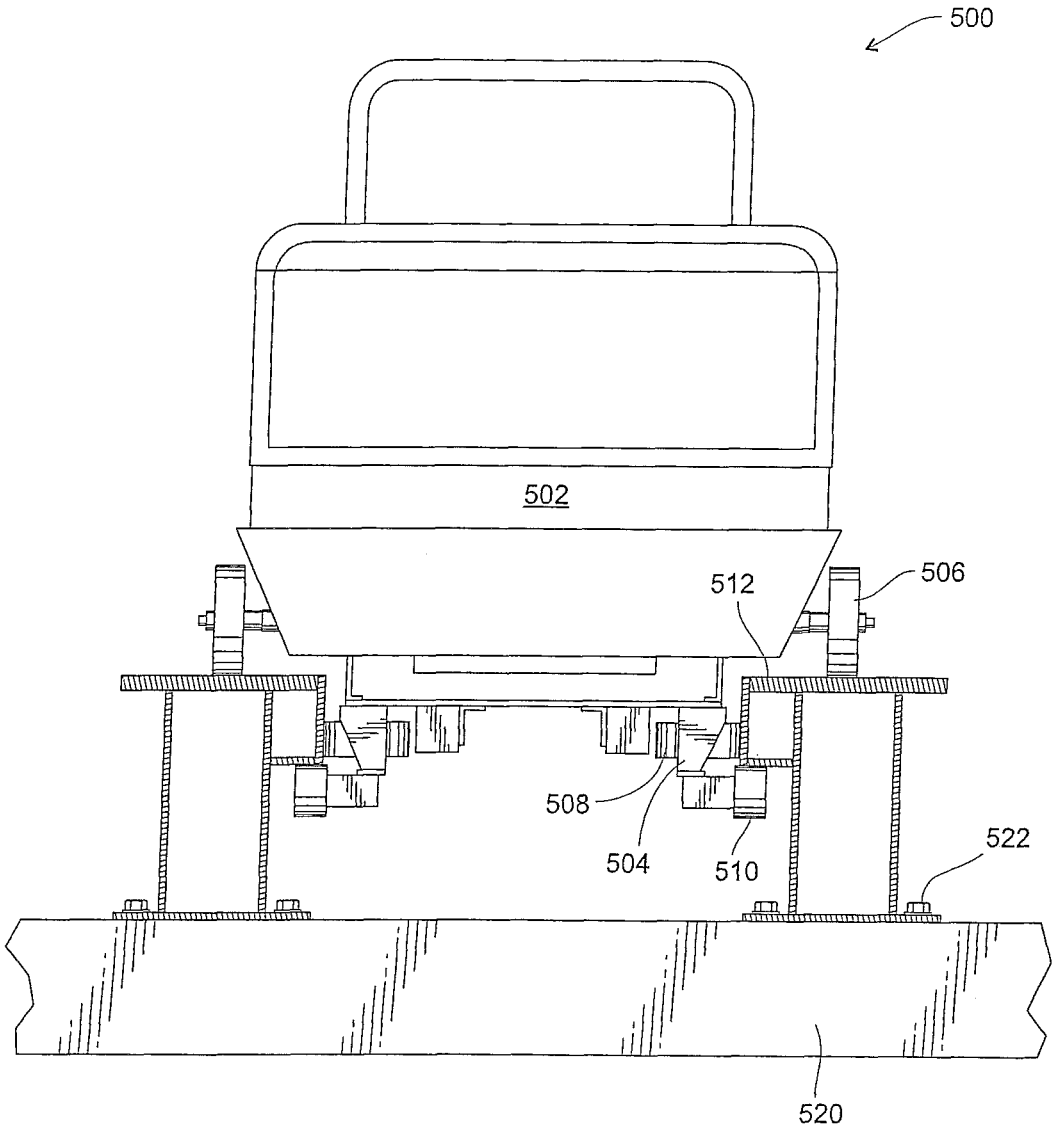
FIG. 5 is a front view of a roller coaster according to an embodiment of the invention.

FIG. 5 is a front view of a roller coaster according to an embodiment of the invention. A coaster 500 comprises a chassis 502 comprising a wheel frame 504, the wheel frame 504 thereby coupled to a one or more main wheels 506, a one or more lateral wheels 508 and a one or more bottom wheels 510. The one or more main wheels 506, one or more lateral wheels 508 and one or more bottom wheels 510 roll along a rectangular cross-section (or "I-beam") track 512 as depicted according to an embodiment of the present invention. Such a coaster 500 is able to take advantage of a more rigid, durable and more easily manufactured track 512 which is constructed from individual planar pieces of material and formed into the rectangular cross-section (or "I-beam") profile.

Another notable advantage to such a track 512 is the ability to couple the track 512 to a ground or horizontal surface 520, which is typically not advisable or utilized in conventional prior art roller coasters (not shown). Namely, such coupling can be accommodated with one or more large bolts coupled to the surface 520.

Figure 6:
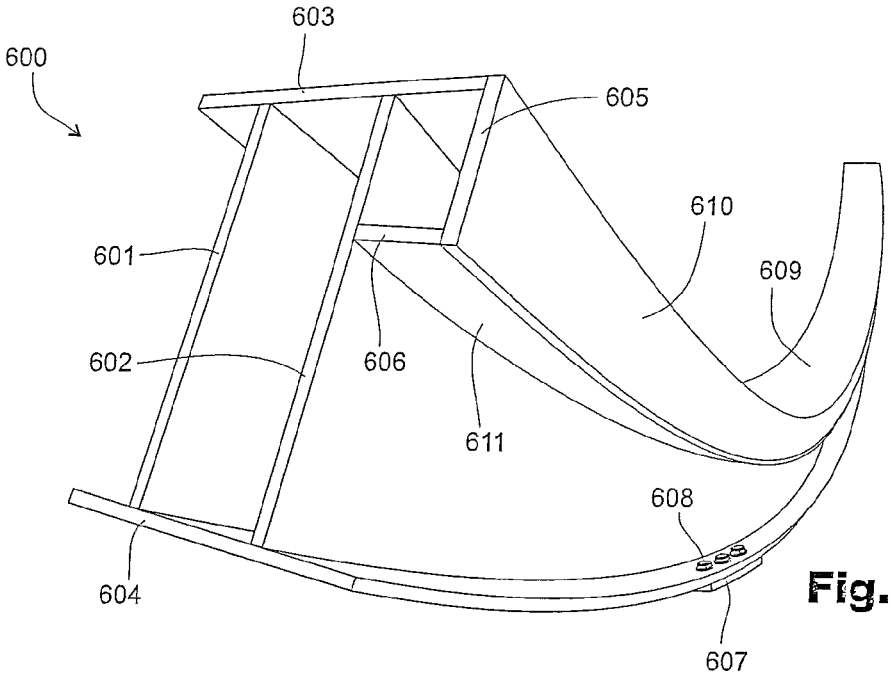
FIG. 6 is a perspective view of an elongated, curved structure according to an embodiment of the invention.

Turning to the next figure, FIG. 6 is a perspective view of an elongated, curved structure according to an embodiment of the invention. A roller coaster track 600 according to an embodiment of the invention is illustrated, namely having a first vertical member 601, a second vertical member 602, a top horizontal member 603, a bottom horizontal member 604, an inside vertical member 605 and an inside horizontal member 606. As noted by reference to the combination of FIGS. 5 and 6, the one or more main wheels 506 roll along a top surface 609, the one or more lateral wheels 508 roll along a lateral surface 610, and the one or more bottom wheels 510 roll along a bottom surface 611. The track 600 can be attached to a support 607 utilizing one or more bolts 608.

Such a track is substantially more rigid than its round counterpart when a comparison of material versus rigidity is made. Further, such a track is inherently stronger and more durable if it is not subjected to stresses during manufacture such as heating or bending.

In order to fabricate such a track 600 in elongated, curved forms, the track 600 comprises a plurality of separate pieces of planar material (e.g. plate steel) which has been cut in a precise, specific desired size and shape.

Figure 7:
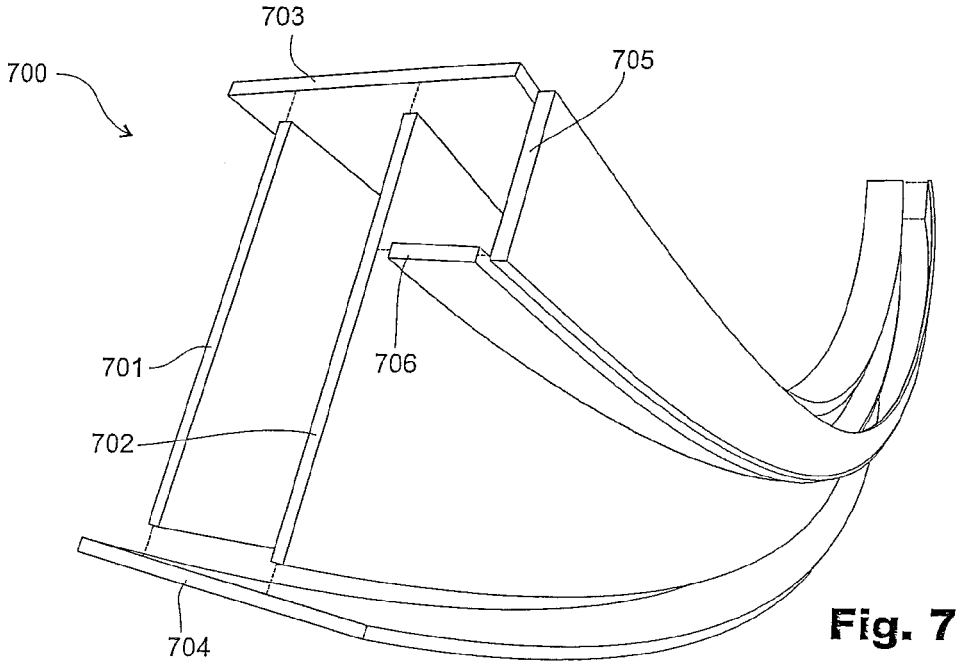
FIG. 7 is an exploded, perspective view of an elongated, curved structure according to an embodiment of the invention.

Turning to the next figure, FIG. 7 is an exploded, perspective view of an elongated, curved structure according to an embodiment of the invention, which demonstrates how such a roller coaster track 700 can be fabricated from separate pieces of planar material such as plate steel. More particularly, a first vertical member 701, a second vertical member 702, a top horizontal member 703, a bottom horizontal member 704, an inside vertical member 705 and an inside horizontal member 706 are all cut, coupled together with conventional coupling means (e.g. welding, adhesive, bolts & nuts, etc.).

In preferred embodiments, such a permanent coupling of the individual pieces can be accommodated by automated welding machines. Depending upon the application and automated machines available, it is often desirable to utilize one or more specialized jigs to hold the plurality of track pieces in a given orientation for permanent coupling. Such a jig that has been successfully developed and utilized is discussed briefly next.

Figure 8:
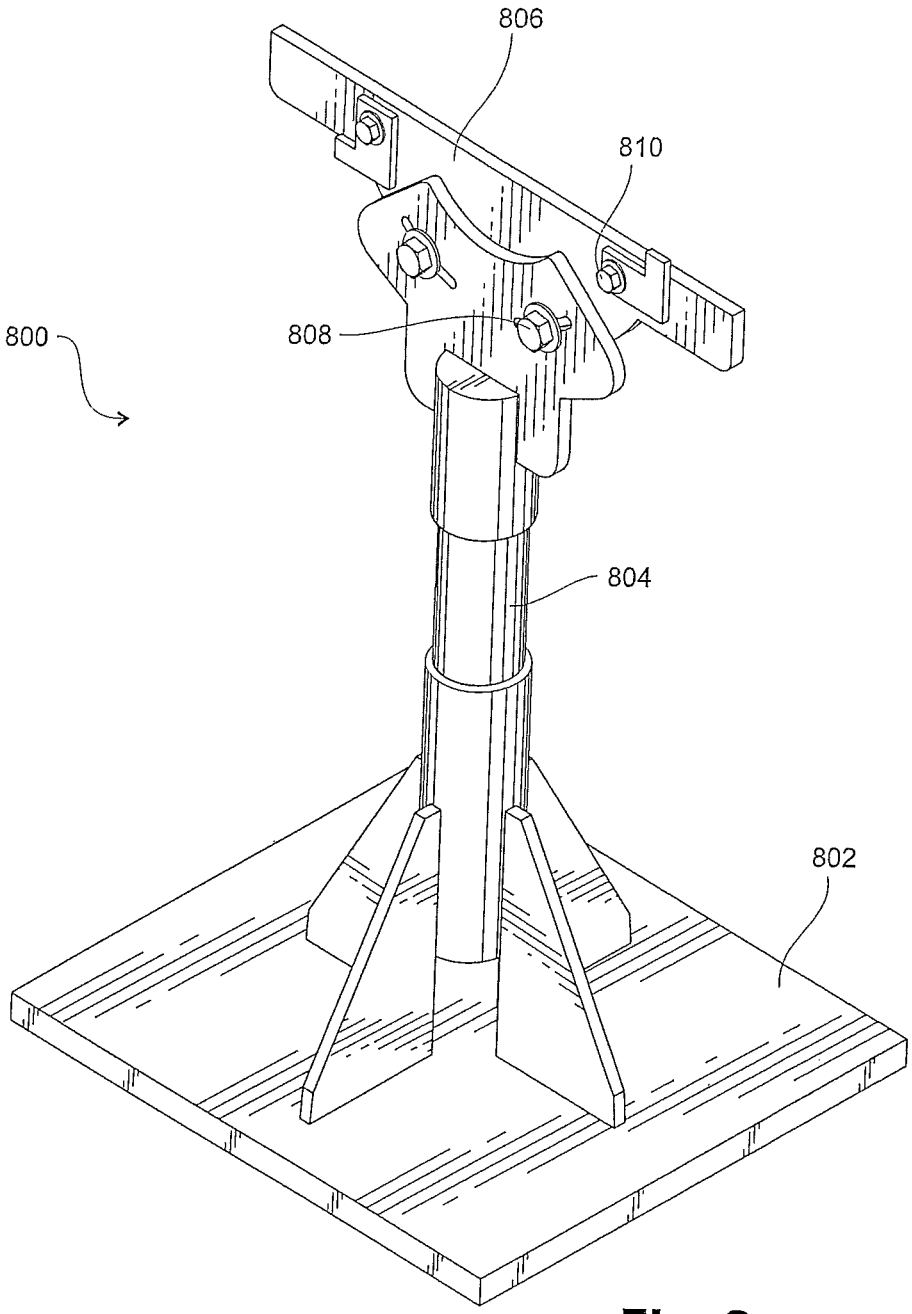
FIG. 8 is a perspective view of a jig according to an embodiment of the invention.

FIG. 8 is a perspective view of a jig according to an embodiment of the invention. A jig 800 comprises a base 802, a vertical leg 804, a horizontal crossbeam 806 and various adjustments. For example, the vertical leg 804 is preferably configurable and of suitable design to allow the crossbar 806 to be placed at any desired height where the track pieces (not shown) can be positioned. Similarly, a one or more bolts 808 are configurable to allow crossbar 806 to be oriented in a wide diversity of angles to accommodate the positioning of the track pieces. It is further preferable to utilize a one or more bolts 810 to provide a notch to hold the track pieces in a specific position upon the crossbar 806.

Figure 9:
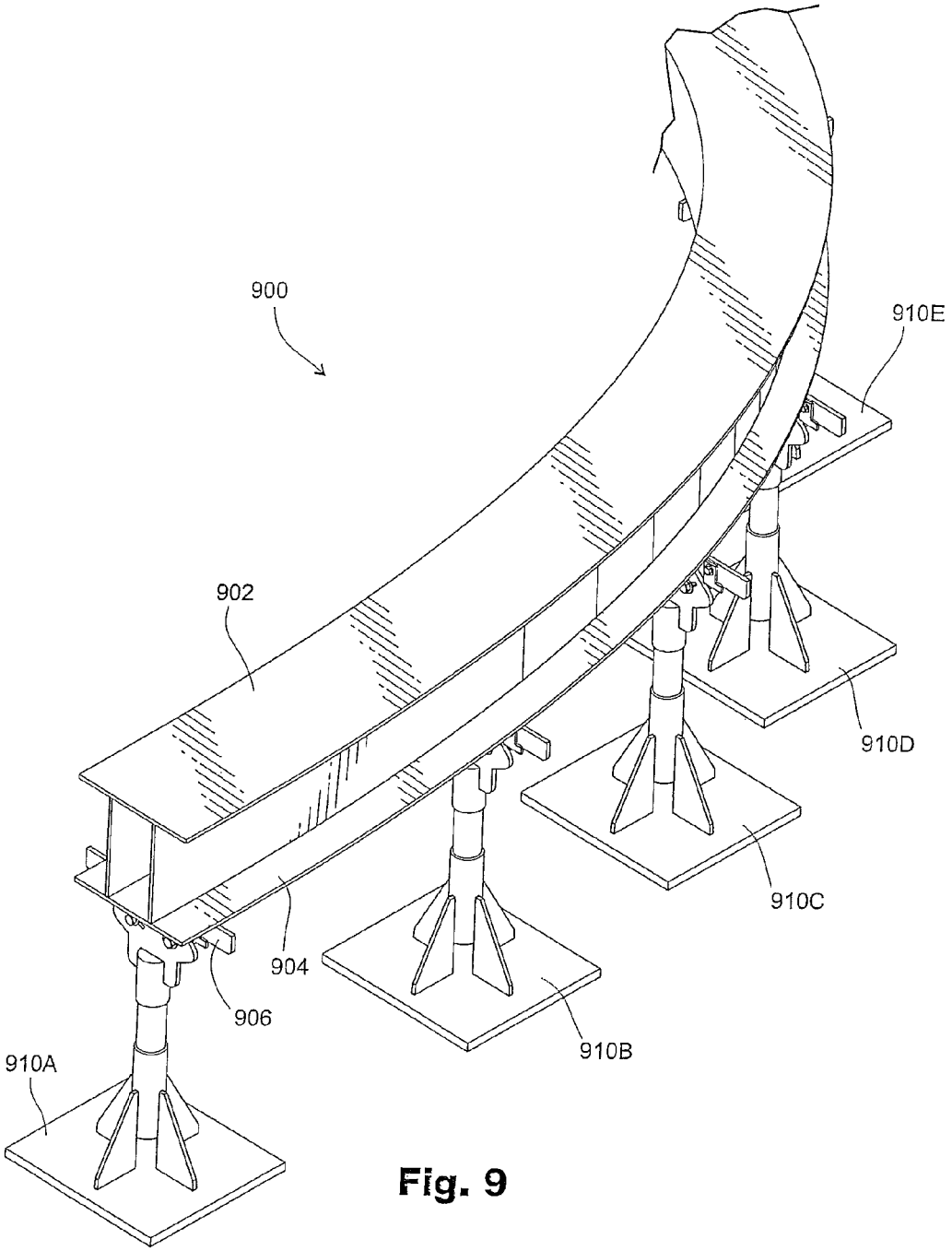
FIG. 9 is a perspective view of an elongated, curved structure being fabricated with a plurality of jigs according to an embodiment of the invention.

Turning to FIG. 9, a perspective view of an elongated, curved structure being fabricated with a plurality of jigs according to an embodiment of the invention is shown. In particular, a track assembly 900 comprises an elongated, curved structure 902 being assembled upon five jigs, namely a jig 910A, a jig 910B, a jig 910C, a jig 910D and a jig 910E. As illustrated, although only exemplary, a bottom member 904 of the structure 902 is in direct communication with a crossbar 906 of the jig 910A, as similarly shown amongst the other jigs. In such a configuration, an automated welding machine (not shown) can couple the various pieces of the structure 902 together in one or more passes of the automated welding machine.

Figure 10:
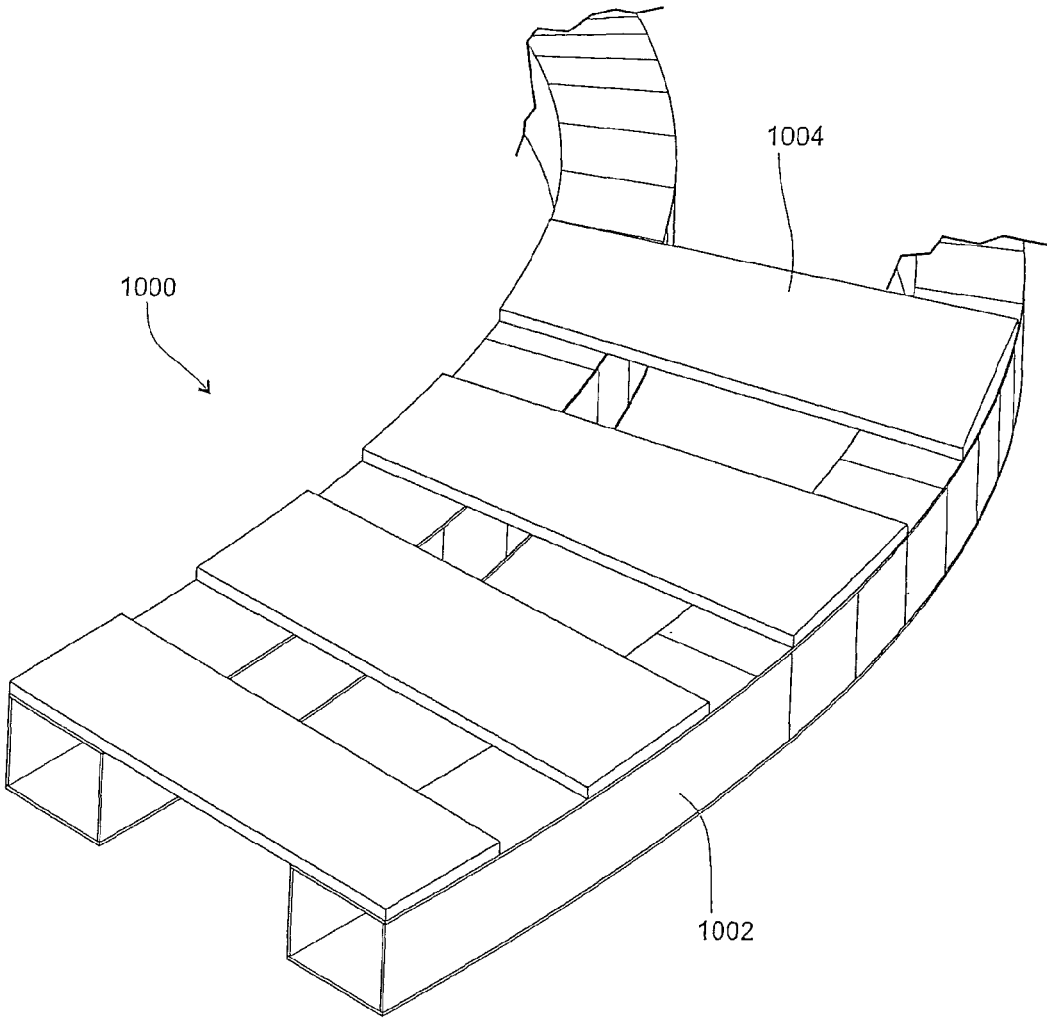
FIG. 10 is a perspective view of a staircase supported by a plurality of elongated, curved structures according to an embodiment of the invention.

Turning to FIG. 10, a perspective view of a staircase supported by a plurality of elongated, curved structures 1002 forming a staircase 1000 according to an embodiment of the invention is illustrated. More particularly, the one or more elongated, curved structures 1002 support a plurality of steps 1004. Using prior art or traditional methods, the one or more elongated, curved structures 1002 would be difficult to manufacture or fabricate, as the structures are comprised of rectangular cross-section shape and would not lend themselves to bending.

As such, the teachings above can also be used to create additional support structures found in ski lifts, people movers (e.g. walkways or trams, motorized or non-motorized), or other architectural features requiring an elongated, curved structure.

CONCLUSION

Unless otherwise indicated, all numbers expressing quantities used in the specification and claims are to be understood as being modified in all instances by the term "about" or "approximately." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. If specific results of any tests are reported in the technical disclosure, any numerical value inherently can contain certain errors necessarily resulting from the standard deviation found in the respective testing measurements.

The terms "a" and "an" and "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as", "in the case", "by way of example") provided herein is intended merely to better describe the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability.

Preferred embodiments of this invention are described herein, including the best mode known to the inventors for carrying out the invention. Of course, variations on those preferred embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, if any references have been made to patents and printed publications in this specification, then each of the above cited references and printed publications, if any, are herein individually incorporated by reference in their entirety.

Of course, ongoing research and development of embodiments of the present invention will likely confer additional details of manufacture and use, as well as other advantages, which may be disclosed in subsequent patent filings though not necessary be outside the scope of the present invention. The existence of such details, advantages or other aspects are not disclaimed in the present disclosure and, notwithstanding the brevity of the present disclosure, are expressly contemplated and included in the present disclosure.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A method of manufacturing a roller coaster track, the method comprising;

creating a design of a curve of a roller track, the curve extending in three dimensions, and the roller coaster track comprising a first member, a second member, a top member adapted to engage a roller coaster car, a bottom member, a first inside member and a second inside member, the top member being coupled to the first member, the second member and the first inside member, the bottom member being coupled to the first member and the first inside member, and the second inside member being coupled to the first inside member and the second member;

mapping out the first member, the second member, the top member, the bottom member, the first inside member and the second inside member on two-dimensional raw materials;

cutting out the members from the raw material;

assembling the cut out members, each without plastic deformation, to form the curve of the roller coaster track.

2. The method of claim 1, wherein the step of assembling comprises assembly by welding.

3. The method of claim 1, wherein the planar material is plate steel having a thickness in the range of approximately ¼ inch to approximately ⅜ inch.

4. The method of claim 1, further comprising the steps of:

providing one or more jigs for holding one or more of the first member, the second member, the top member, the bottom member, the first inside member and the second inside member in a given orientation for permanent assembly.

5. A roller coaster track produced by the method of claim 1.

6. A method of manufacturing a roller coaster track, the method comprising;

creating a design of a curve of a roller coaster track, the curve extending in three dimensions, and the roller coaster track comprising a first member adapted to engage a roller coaster car, a second member coupled to the first member, a third member coupled to the second member, and a fourth member coupled to the third member and the first member;

mapping out each member on planar material as laid flat, the planar material having substantially uniform thickness;

cutting out each mapped member from the planar material;

without plastic deformation, flexing each cut-out member according to the design to form the curve of the roller coaster track; and after said flexing, coupling the second member to the first member, the third member to the second member, and the fourth member to the third member and the first member to form the curve of the roller coaster track according to the design.

7. The method of claim 6, wherein the curve comprises an inversion.

8. The method of claim 6, wherein the curve comprises a corkscrew.

9. The method of claim 6, wherein the planar material comprises steel.

10. The method of claim 9, wherein the step of coupling comprises welding.

11. A method of manufacturing a roller coaster track, the method comprising;

creating a design of a curve of a roller coaster track, the roller coaster track comprising a first member adapted to engage a roller coaster car, a second member coupled to the first member, a third member coupled to the second member, and a fourth member coupled to the third member and the first member, each member being designed to comprise a material having a substantially uniform thickness, the curve being designed so that each of the members do not undergo plastic deformation when flexed according to the design of the curve;

creating a map of each member as laid flat such that each member can be cut out from planar material laid flat and having substantially uniform thickness.

12. The method of claim 11, the curve extending in three dimensions.

13. The method of claim 11, comprising:

cutting out each member from the planar material;

without plastic deformation, flexing one or more of the cut-out members according to the design to form the curve of the roller coaster track; and coupling the second member to the first member, the third member to the second member, and the fourth member to the third member and the first member to form the curve of the roller coaster track according to the design.

* * * * *